US012577734B2

(12) United States Patent
Austin

(10) Patent No.: US 12,577,734 B2
(45) Date of Patent: Mar. 17, 2026

(54) RAIL ANCHORING SPIKE

(71) Applicant: Lewis Bolt & Nut Company, Wayzata, MN (US)

(72) Inventor: Timothy John Austin, Rocky Ford, CO (US)

(73) Assignee: Lewis Bolt & Nut Company, Wayzata, MN (US)

( * ) Notice: Subject to any disclaimer, the term of this patent is extended or adjusted under 35 U.S.C. 154(b) by 792 days.

(21) Appl. No.: 17/799,489

(22) PCT Filed: Feb. 18, 2021

(86) PCT No.: PCT/US2021/018490
§ 371 (c)(1),
(2) Date: Aug. 12, 2022

(87) PCT Pub. No.: WO2021/168059
PCT Pub. Date: Aug. 26, 2021

(65) Prior Publication Data

US 2023/0070978 A1 Mar. 9, 2023

Related U.S. Application Data

(60) Provisional application No. 62/977,929, filed on Feb. 18, 2020.

(51) Int. Cl.
*E01B 9/06* (2006.01)
*E01B 29/26* (2006.01)

(52) U.S. Cl.
CPC ..... *E01B 9/06* (2013.01); *E01B 29/26* (2013.01); *E01B 2201/04* (2013.01)

(58) Field of Classification Search
CPC ..... E01B 9/06; E01B 9/10; E01B 9/02; E01B 9/12
See application file for complete search history.

(56) References Cited

U.S. PATENT DOCUMENTS

| | | | | |
|---|---|---|---|---|
| 2,049,105 | A | 7/1936 | Clarke | |
| 2,169,408 | A | 8/1939 | De Vellier | |
| 2,269,708 | A | 1/1942 | Dickson | |
| 2,650,032 | A | 8/1953 | Godfrey | |
| 4,159,666 | A * | 7/1979 | Briles | F16B 19/06 411/507 |

(Continued)

OTHER PUBLICATIONS

International Preliminary Report on Patentability in International Appln. No. PCT/US2021/018490, mailed on Sep. 1, 2022, 9 pages.

(Continued)

*Primary Examiner* — Scott A Browne
(74) *Attorney, Agent, or Firm* — Fish & Richardson P.C.

(57) ABSTRACT

An improved rail anchoring spike that includes a conical swell adapted to engage with a hole in a metal tie plate during fastening of the metal tie plate to a tie. The conical swell has a smaller diameter toward a pointed end of the spike and a larger diameter toward a head of the spike. The smaller diameter is slightly larger than a diameter of a body of the spike. An angle formed by the conical swell relative to a center line passing through a center of the body of the spike matches an angle of the hole in the metal tie plate relative to a center of the hole.

9 Claims, 4 Drawing Sheets

(56) References Cited

U.S. PATENT DOCUMENTS

| | | | | |
|---|---|---|---|---|
| 5,024,381 | A * | 6/1991 | Stafford, III | E01B 9/06 238/295 |
| 5,741,104 | A | 4/1998 | Lat et al. | |
| 6,808,120 | B2 * | 10/2004 | Oram | E01B 9/10 411/453 |
| 7,232,283 | B2 * | 6/2007 | Dill | F16B 15/06 411/456 |
| 8,683,842 | B1 | 4/2014 | Newell | |
| 2008/0286072 | A1 | 11/2008 | Stiebitz et al. | |
| 2018/0298934 | A1 | 10/2018 | Eckert et al. | |

OTHER PUBLICATIONS

International Search Report and Written Opinion in International Appln. No. PCT/US2021/018490, mailed on Apr. 29, 2021, 10 pages.

* cited by examiner

RAIL ANCHORING SPIKE

CROSS-REFERENCE TO RELATED APPLICATION

This application is a National Stage Application under 35 U.S.C. § 371 of International Application No. PCT/US2021/018490, filed on Feb. 18, 2021, which claims priority to U.S. Provisional Application Ser. No. 62/977,929, filed on Feb. 18, 2020. The disclosures of the prior applications are considered part of and are incorporated by reference in the disclosure of this application.

TECHNICAL FIELD

This present disclosure relates to fasteners for attaching metal to wood, and more particularly to an improved railroad spike and corresponding railroad tie plate for attaching a metal rail to a wooden tie.

BACKGROUND

It is common in constructing tracks for trains to provide a rail or rails supported on cross ties formed of wood. The rails are commonly made of a metal such as steel, and are generally provided with mounting flanges. The mounting flanges are adapted to rest on metallic bearing plates, commonly referred to as tie plates or fishplates. The fishplates in turn rest on the wooden ties. It is common to employ spikes (e.g., cut spikes) for securing rails to ties. In the usual case, a spike is inserted in an opening or cavity in the fishplate and the spike shank is driven into the tie. The head of the spike is generally adapted to engage with the flange of the rail, thereby securing the rail to the tie. Alternatively, the fishplate may be equipped with a metal clip or boss that engages to the flange of the rail, and the head of the spike is adapted to engage with the fishplate to secure the rail to the tie.

Over time, ties tend to deteriorate, generally beginning at the top of the tie and progressing downward toward lower portions of the tie. The deterioration can cause the upper portion of the tie to be weaker than the lower portion of the tie. Therefore, after being in service for a period of time, an ordinary spike can often work loose from the tie. This is further caused by the working action that occurs as the rail deflects under the load of passing trains and due to expansion and contraction of the wood fibers of the tie due to temperature, humidity, and other environmental changes. Such loosening of the spike can necessitate replacement of the spike or other parts of the track assembly. Attempts to secure or anchor a spike by providing the shank with burrs, barbs, serrations, or similar rough features adapted to engage with the wooden ties generally have proven unsatisfactory. Such spikes can be difficult to drive into a tie using manual or automated impact spike-driving methods. The rough feature may also chew or tear the wood fibers of the tie during installation, thereby causing damage to the tie.

In addition, after such spikes have been in service for an appreciable length of time, the spikes will have a tendency to work in the hole established in the tie by the spike shank. Working of the spike acts to enlarge the hole surrounding the shank and to damage the surrounding wood fibers, causing the spike to loosen over time. The enlarged hole may also permit water and chemicals to enter the hole surrounding the spike shank, thereby further weakening the spike or the surrounding wood fibers. Removal of the spike usually causes additional damage to the tie. Therefore, spike removal often requires replacement of the entire tie in order to ensure that the replacement spike will anchor the rail to the tie with sufficient holding power.

Spikes have been adapted with threaded shanks that can be screwed into the wooden tie. However, such spikes are difficult to install using manual or automated impact driving methods. Furthermore, such spikes generally require a pre-drilled hole in the tie to facilitate installation using rotary spike driving methods. Threaded spikes are also known to work loose under the load of passing trains. In an attempt to reduce working of spikes under load, attempts have been made to equip spikes with tabs or uniquely shaped shanks adapted to engage with the cavity of a fishplate, thereby locking the spike into engagement with the fishplate, reducing the tendency of the spike to work loose and damage the tie. Such spikes, however, are extremely difficult to install using automated impact spike-driving methods. In addition, such spikes can generally be used only in conjunction with a fishplate, and are extremely difficult to remove once locked into engagement with the fishplate.

The art continually searches for improved spikes suitable for use in securing a metal rail to a wooden tie. In particular, the art continues to search for spikes that exhibit a reduced tendency to work loose under the load of passing trains, for spikes that are readily removed and re-installed without requiring replacement of the tie, and for spikes that are capable of installation using automated spike-driving methods.

Some premium fastening systems that use clips, for example, to secure the rail to the tie plate do not use anchors. These and other systems frequently use screws to secure the plate to the tie. Some railroads (for example, in the United States and Canada) are seeing a number of broken screws or spikes on premium fastening systems. One of the issues that can cause broken screws or spikes is that horizontal loads are carried only by two spikes even if three or more screws are typically used. Breakage can occur, for example, when holes in the plate are larger than the screws, preventing the plate from touching two or more of the screws in many cases. This lack of contact by some of the screws can cause the screws that are in contact with the plate to encounter forces higher than their fatigue strength, eventually causing the screws to break. Only then do the remaining screws take up the loads, which ultimately can be too much for the remaining screws as well.

SUMMARY

This present disclosure relates generally to an improved fastener for attaching metal to wood. A spike design includes a conical swell having an angle matching an angle of holes in a metal tie plate. When multiple spikes are installed to fasten the metal tie plate, the conical shapes of the spikes and metal tie plate enable better contact of the metal tie plate by the spikes than when conventional shapes are used. This allows the horizontal load to be more evenly distributed among all of the spikes.

The improved spike can be used, for example, as a rail anchoring spike to fasten metal to a tie (such as a wooden tie). The spike includes a head having a flange. The spike also includes a stand-off extending axially from the flange. The spike further includes a shank that extends axially from the stand-off to form a tapered tip. The shank is adapted to engage the tie by a combination of threads and barbs on the shank. For example, the shank includes a plurality of helical, generally parallel threads extending over a threaded portion of the shank. The threads run from the stand-off to the tapered tip. The stand-off has a length adapted to ensure that the threads are fully engaged in the tie when the spike is used to fasten metal to the tie. The threads are adapted to engage the tie at a depth in the tie that ensures engagement with dense material of the tie.

The shank includes a plurality of barbs positioned in a lower half of the threaded portion. Each of the barbs is positioned between a pair of threads. Each barb is configured to minimize damage to fibers of the tie during installation of the spike as fibers of the tie relax behind, and engage with, a barbed end of each barb. This prevents movement of the spike over time despite deterioration of the tie. Each of the barbs is positioned along the threaded portion such that the barbs contact a lower portion of the tie when the spike is installed in a rail assembly.

In some embodiments, each of the barbs includes a starting point, a pointed barb, and a barb body. The starting point is oriented away from the flange and originates in a valley between the pair of threads. The pointed barb is on the barbed end of the barb. The barb body extends from the starting point to the barbed end. The barb body grows in height and width relative to the valley. The barb end forms a substantially flat surface oriented generally perpendicular to an axis of the barb and to ridges formed by the pair of threads.

In some embodiments, the threads are adapted to facilitate driving of the spike into the wooden tie using impact or rotary spike-driving methods, and to permit easy removal of the spike using rotary spike removal methods. In some embodiments, the threaded shank is adapted to permit driving of the spike into the tie using an impact driving method, and to permit easy removal of the spike using a wrench or other rotary spike removal method. The threads are adapted to cause rotation of the spike into the tie during installation using automated or manual impact spike-driving methods. The threads are preferably adapted to screw the spike threads into the wooden tie when a force is applied to the hemispherical head of the spike in a direction generally towards the spike tip.

In some embodiments, the improved spike is used with a metal tie plate or fishplate to secure the rail to the tie. In this embodiment, the length of the stand-off must be adapted to ensure that the threads are at least partially engaged with the wooden tie when the spike is driven into the tie. The metal tie plate or fishplate preferably comprises a metal boss or an elastic fastener that is adapted to engage with the flange of the rail, thereby securing the rail to the tie when the spike is driven into the tie.

In another aspect, the present disclosure features an improved railroad track assembly. The assembly comprises a metal rail, a tie (e.g. wooden), a metal tie plate adapted to engage the rail, and an improved spike of the present disclosure. The improved spike is driven into the tie. The spike is adapted to fasten the metal tie plate and the rail to the tie. The improved spike includes features as previously described.

In still another aspect, the present disclosure features a method of using an improved railroad spike. The method includes using a railroad spike for fastening metal to a tie. A railroad spike is provided that includes features as previously described. A wooden tie, a metal rail, and a fishplate adapted to engage with the rail and the tie are provided. The spike is driven into the tie until the threads and the barbs are embedded in the tie, and the fishplate is engaged with the rail.

In some embodiments, the fishplate further includes a metal boss that is adapted to hold the rail onto the tie. In some embodiments, the fishplate includes a top face, a lower face, and a cavity having a length extending between the top face and the lower face. In some embodiments, the length of the stand-off is a 1.5-2.5 inches (e.g., 2 inches).

In some variations of this embodiment, an automated spike-driving method is used to drive the spike into the tie, thereby securing a metal rail to the wooden tie. Preferably, an automated impact spike-driving method is employed. In alternative embodiments, a manual spike driving apparatus is used to drive the improved spike into the tie.

The details of one or more embodiments of the present disclosure are set forth in the accompanying drawings and the description below. Other features, objects, and advantages of the present disclosure will be apparent from the description and drawings, and from the claims.

DESCRIPTION OF DRAWINGS

Like reference symbols in the various drawings indicate like elements.

DETAILED DESCRIPTION

The present disclosure describes a railroad spike and assembly. The railroad spike includes a tapered neck to engage with a tapered hole in a fish plate (or a rail tie plate or a metal tie plate) of the assembly. The railroad spike can be used with techniques and assemblies in which metal tie plates and screws are modified with a tapered mating surface to secure the screws to the metal tie plate so that all the screws can take a portion of the load. Such techniques and assemblies for improved metal tie plates and screws can provide an improved railroad spike for attaching a metal rail to a metal tie plate, for example.

In some implementations, a screw having a tapered mating surface can be generally similar to the Evergrip™ or Evergrip G2™ screw spike (manufactured by Lewis Bolt and Nut Company).

The screw includes a conical swell just under the head. The conical swell is smaller in diameter toward the pointed end of the screw and larger in diameter toward the head of the screw. The smaller end of the conical swell is slightly larger than the diameter of the body of the screw. In some implementations, an angle formed by a conical shape of the conical swell is, for example, 9° relative to a center line passing through the body of the screw, from a center of the screw's head to a center of the screw's pointed end. Implementations using other angles are possible.

The conical swell of the screw is angled to fit a similar angle of a hole in the metal tie plate. For example, the hole in the tie metal tie plate can include a conical tapered cavity with the same angle as the conical swell of the screw. Such metal tie plates can be manufactured specifically to match the conical shape of the screw. The hole in the metal tie plate has a diameter that is the same size or slightly larger than the diameter of smaller end of the taper on the screw.

Installation of the screw (having the conical swell) into a metal tie plate having a conical tapered cavity can be performed without the need for a flat washer against the metal tie plate. This is because the screw is automatically seated into the tapered hole.

Evergrip™ or Evergrip G2™ screw spikes are normally (and preferably) pounded in, using a force delivered vertically to the top of the head. If needed, screw spikes can also be turned in. These techniques help to secure the screw to the metal tie plate with an interference fit in the matching tapers. An interference fit, for example, refers to a fit between two parts, where an external dimension of a first part slightly exceeds an internal dimension of a second part into which the first part needs to fit.

The same principals associated with screws having the conical swell can be applied to any screw. For example, while the principals in this disclosure apply well with Evergrip™ or Evergrip G2™ screw spikes, the same and different principals may apply with conventional and other screw spikes, threaded or not.

Figure 1:
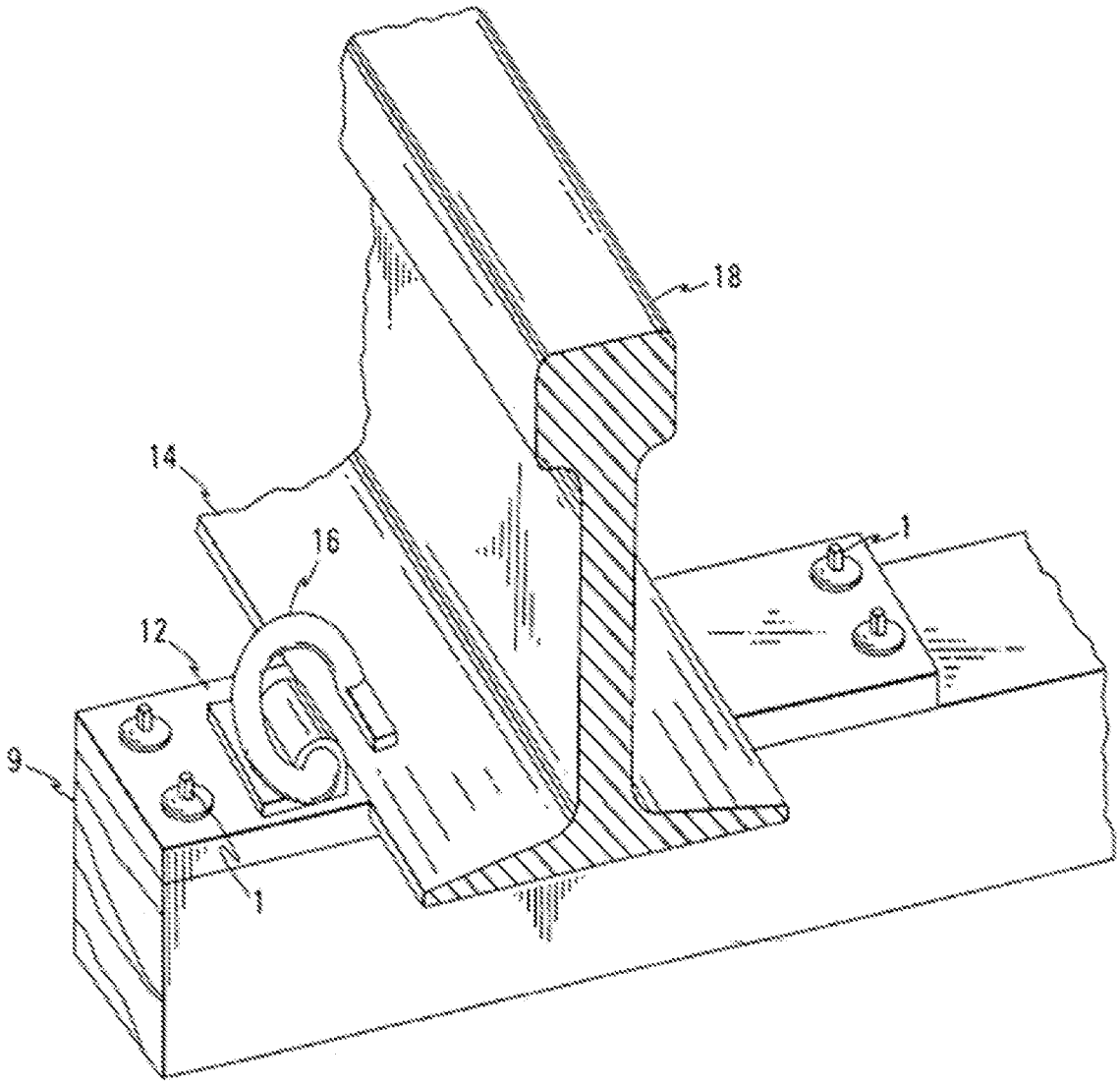
FIG. 1 is a perspective view of an example of a typical metal-to-wood fastening application embodying the present disclosure.

FIG. 1 is a perspective view of an example of a typical metal-to-wood fastening applications embodying the present disclosure. FIG. 1 illustrates the fastening of a metal rail 18 to a wooden tie 9 using a spike 1 (an improved spike) of the present disclosure. In the illustrated embodiment, a metal tie plate or fishplate 12 comprising a boss or elastic fastener 16 engages with the flange 14 of rail 18. A plurality of spikes 1 are inserted into cavities in the fishplate 12, to secure the fishplate 12 and the rail 18 to the tie 9.

FIG. 1 also represents a railroad tie assembly in which the spike 1 includes conical swell that, when installed, engages with a hole in a metal tie plate. An angle of the conical swell matches an angle of the tapered hole in the metal tie plate.

Figure 2A:
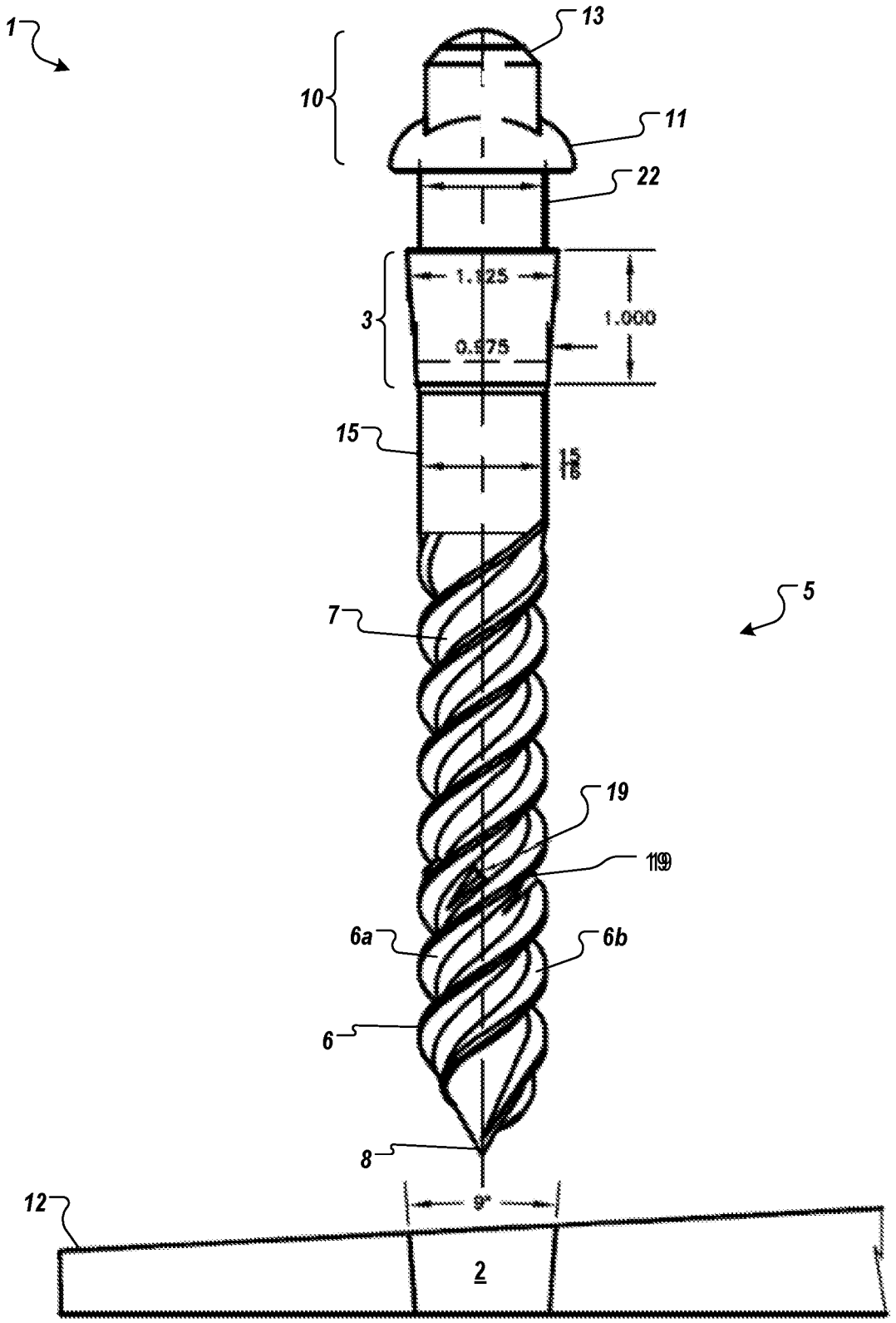
FIGS. 2A and 2B are side elevation views of an example of a spike embodying the present disclosure.
Figure 2B:
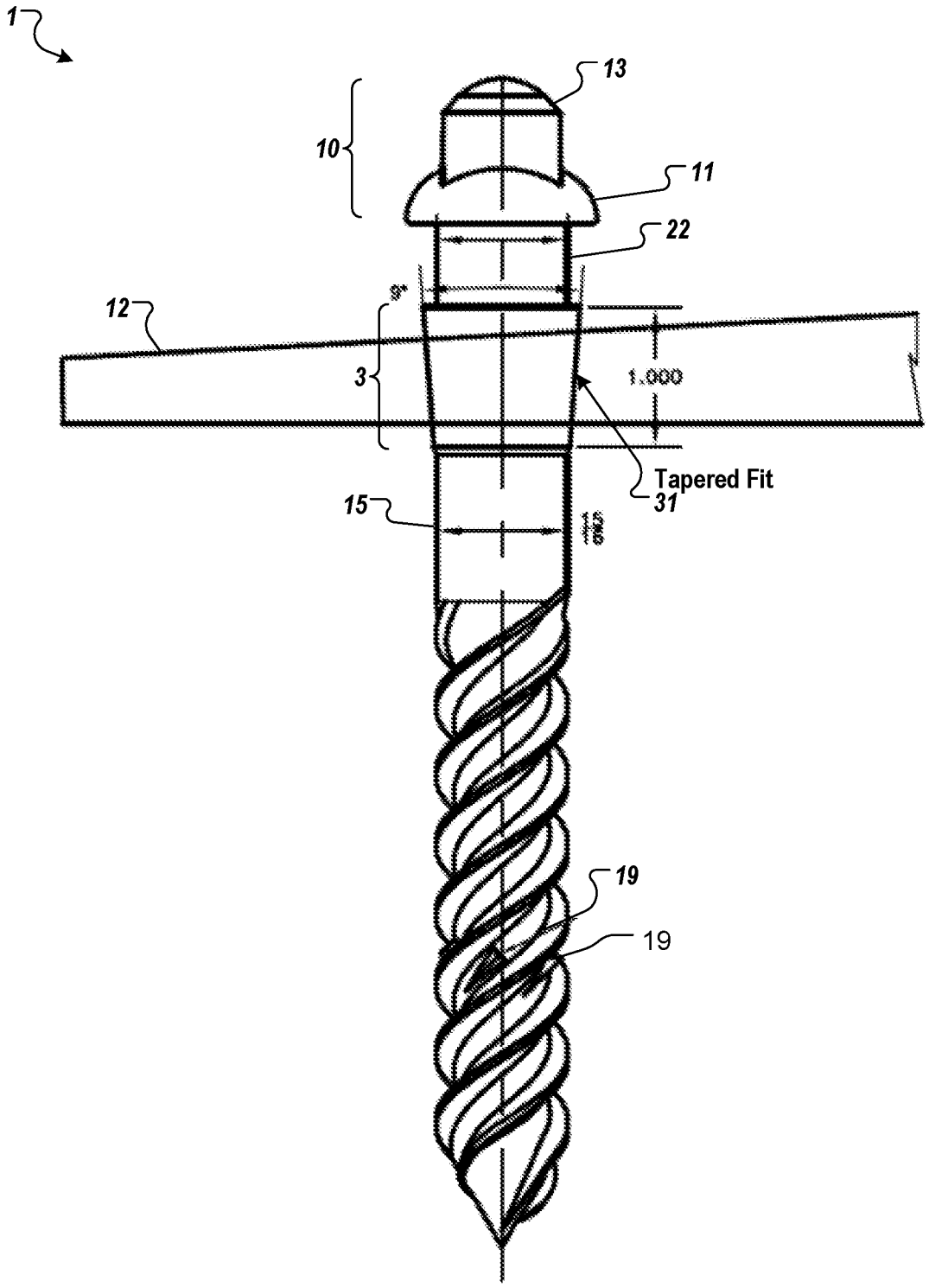

FIGS. 2A and 2B are side elevation views of an example of a spike embodying the present disclosure. FIG. 2A shows the spike 1 not yet engaged with the fishplate 12, for example, before the fishplate 12 is attached to a tie using multiple spikes 1. FIG. 2A shows the spike 1 engaged with the fishplate 12, for example, after the fishplate 12 has been attached to a tie using multiple spikes 1.

The spike 1 includes a conical swell 3 that is adapted to engage with a hole (for example, cavity 2) in a metal tie plate during fastening of the metal tie plate to a tie. The conical swell has a smaller diameter (for example, 0.975 inches) toward a pointed end of the spike (for example, at a tapered tip 8). The conical swell has a larger diameter (for example, 1.1275 inches) toward a head 10 of the spike. The smaller diameter of the conical swell is the same size or slightly larger than a diameter (for example, 15/16 inch, or 0.9375 inches) of a body of the spike. An angle formed by the conical swell relative to a center line passing through a center of the body of the spike matches an angle of the hole in the metal tie plate relative to a center of the hole. This angle can be achieved, for example, if a length of the conical swell 3 relative to an overall length of the spike is 1 inch. The interference fit provided by the conical swell 3 and a tapered hole of the fishplate 12 allows a spacer portion 22 to remain above the fishplate 12 after installation of the spike 1. This makes it possible to include, in the spike 1, a single flange 11 (instead of requiring two or more flanges) for future removal of the spike 1 using a spike remover.

FIG. 2A further illustrates use of the spike 1 in combination with the metal fishplate 12, having the cavity 2. The fishplate cavity 2 has a diameter greater than or equal to the diameter of the stand-off 15, and preferably has a diameter greater than or equal to the diameter of the threaded shank 5. Preferably, the stand-off 15, the threaded shank 5, and the fishplate cavity 2 are all substantially cylindrical.

The spike 1 includes barbs 19 positioned between threads 6 of a threaded portion of the spike 1. The barbs 19 are positioned in a lower half of the threaded portion. Each barb is configured to minimize damage to fibers of a wooden tie 9 during installation of the spike 1 as fibers of the tie 9 relax behind, and engage with, a barbed end of each barb. This prevents movement of the spike over time despite deterioration of the tie. Each of the barbs is positioned along the threaded portion such that the barbs contact a lower portion of the tie when the spike is installed in a rail assembly.

The spike has a stand-off 15 extending axially from a flange 11. The spike has a shank 5 extending axially from the stand-off 15 to form the tapered tip 8. The shanks 5 contains a plurality of pitched, helical, generally parallel threads 6 extending over at least a portion of the shank, running from the stand-off 15 to the tapered tip 8. The threads have an upper thread surface 6*b*, and a lower thread surface 6*a*.

As shown in FIG. 2A, the helical threads preferably have an upper thread surface 6*b* which defines an obtuse pitch angle relative to the nearest adjacent land 7 which is substantially closer to ninety degrees than the pitch angle defined between the lower thread surface 6*a* and the nearest adjacent land 7. Because this thread design allows the spike 1 to freely screw into the tie 9 when a force is applied to the head (e.g., the spike is driven), such a thread design is particularly well suited for use with automated spike driving equipment. Most preferred is automated impact spike driving equipment that drives the spike by applying a force to the spike head substantially in the direction of the tip of the shank. Suitable automated spike driving equipment includes, for example, the Nordco Model CX Spike Driver (Nordco, Inc., Milwaukee, Wisconsin). Other manufacturers may provide similar equipment.

Figure 3A:
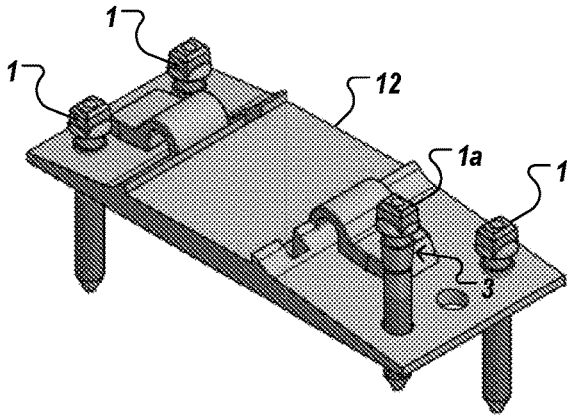
FIG. 3A is a perspective view of an example of spikes inserted in holes in a metal tie plate embodying the present disclosure.

FIG. 3A is a perspective view of an example of spikes inserted in holes in a metal tie plate embodying the present disclosure. In this view, three spikes 1 have been driven through holes in the fishplate 12 and into a tie. A fourth spike 1*a* is shown inserted in a hole of the fishplate 12 and not yet driven into the tie. This position of the fourth spike 1*a* illustrates the position of the conical swell 3. Some implementations can use as few as two or three spikes, or more than four spikes.

Figure 3B:
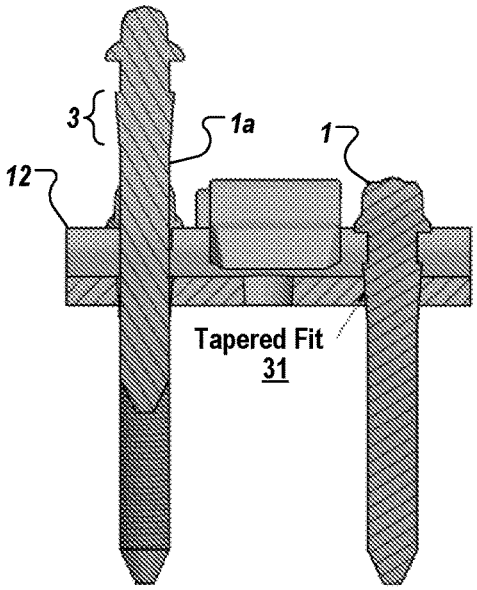
FIG. 3B is a side view elevation view of an example of a spike with a conical swell embodying the present disclosure.

FIG. 3B is a side view elevation view of an example of a spike with a conical swell embodying the present disclosure. FIG. 3B provides a view of a short end of the fishplate 12. In this view, the spike 1 is fully-driven (providing a tapered fit 31) and the spike 1*a* is partially-driven.

Figure 3C:
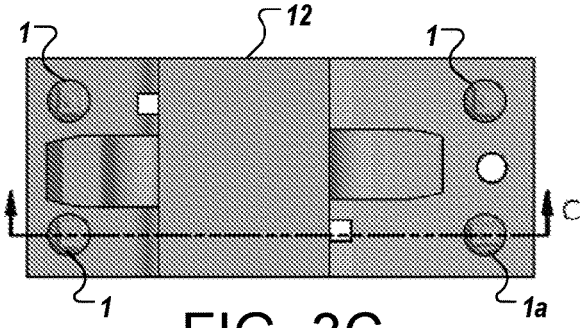
FIG. 3C is a top plan view of an example of the spike embodying the present disclosure.

FIG. 3C is a top plan view of an example of the spike embodying the present disclosure. In this view, the tops of the spikes 1 and 1*a* are shown.

Figure 3D:
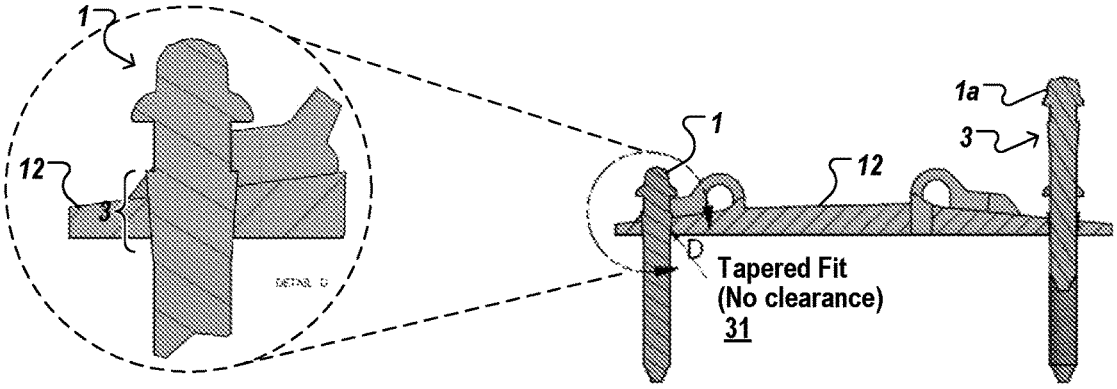
FIG. 3D is a side elevation view showing an example of a spike with a conical swell embodying the present disclosure.

FIG. 3D is a side elevation view showing an example of a spike with a conical swell embodying the present disclosure. FIG. 3D provides a view of a long edge of the fishplate 12.

A hemispherical head 13 can be provided to permit driving of the spike into the tie using impact spike driving methods that apply a force to the head 13 of the spike in the general direction of the spike tip. The hemispherical head 13 is preferably deformable by virtue of the material used to make the head 13, and is adapted to deform slightly under impact driving, thereby preventing damage to the tool grip that could prevent removal of the spike using a wrench. In addition, the thread design allows the spike 1 to be readily driven using hand operated impact spike driving equipment such as hammers, sledges, mauls, or power-driven/hand operated spike drivers such as the Ingersol Rand Spike Driver Model MX60, (Ingersol Rand, Inc.), Ingersol Rand Spike Driver Model MX 90 (Ingersol Rand, Inc.), or the like.

Preferably, the pitched helical threads 6 are adapted to permit driving of the spike 1 into the tie 9 using a generally clockwise rotary motion applied to the tool grip, and to permit removal of the spike 1 from the tie 9 using a generally counter-clockwise rotary motion applied to the tool grip. Both clockwise and counterclockwise directions refer to the rotational direction of the tool grip when viewing the spike from the side of the flange opposite to the shank. Alternatively, the threads 6 are adapted to permit driving of the spike 1 into the tie 9 using a generally clockwise rotary motion applied to the tool grip, and to permit removal of the spike 1 from the tie 9 using a generally counter-clockwise rotary motion applied to the tool grip.

The spike 1 is generally used with a metal tie plate or fishplate 12 to secure the rail 18 to the tie 9. If a fishplate is used, the fishplate preferably comprises a metal boss or elastic fastener 16 adapted to engage with the flange 14 of the rail. The fishplate also includes a cavity (for example, a conical tapered cavity) through which the shank of the spike may be inserted to permit driving of the spike into the tie. As shown in FIGS. 1A and 1B, the rail flange 14 preferably rests on the tie plate or metal fishplate 12, and the tie plate or fishplate 12 preferably rests on the wooden tie 9.

It will be understood by those skilled in the art that the diameter and overall length of the spike are not critical, and may be varied according to the dimensions of the tie and tie plate or fishplate. Even though the overall length of the spike is not critical and may be any suitable length, this length is generally in the range of 15-25 cm. However, the length of the stand-off 15 must be adapted to ensure that the threads are engaged with the wooden tie 9 when the spike 1 is driven into the tie 9. This also ensures that the barbs 19 are engaged with the wooden tie 9 with a force sufficient to prevent or reduce the tendency for the spike to loosen under the load of passing railroad locomotives and rolling stock (not shown).

Notwithstanding the improvements embodied in the present disclosure, it will be understood by those skilled in the art that it may be necessary to replace components of a railroad track assembly due to damage or wear. Such replacement will generally require the removal of one or more spikes. It is understood that some damage to the wooden tie may occur due to repeated removal or installation of improved spikes of the present disclosure.

The head design of the spike depicted in FIGS. 2A and 2B aids in the removal of the spike. The flange 11 and the spacer portion 22 allow for a claw or other automated or manual tool to engage or grip the spike and remove it. The flange 11 is preferably circular, but may be of any shape suitable for the intended application. When installed, the head 10 will be exposed for use with a claw or other automated or manual tool to remove the spike 1.

Preferably, the spike comprises a metal. Although the spike may be made of any number of metals or metal alloys, ferrous metals such iron or steel are preferred. Ferrous metals are preferred for use with an automated spike driving apparatus, since magnetic forces may then be used to hold the spike in operational engagement with the driving device.

Another aspect of this present disclosure provides an improved railroad track assembly. The assembly comprises a metal rail, a wooden tie, a metal tie plate adapted to engage the rail, and an improved spike of the present disclosure. The improved spike is described in the previous detailed description of the present disclosure and in FIGS. 1-3D.

In an embodiment of this improved track assembly, the improved spike is driven into a wooden tie to secure a metal rail and a metal tie plate to the tie. The tie plate is adapted to engage the rail at the rail flange.

In some variations of this embodiment, the shank further comprises a plurality of helical, generally parallel threads extending over at least a portion of the shank, running from the stand-off to the tip. In one variation of this embodiment, the threads are adapted to permit driving of the spike into the tie using an impact driving method, and to permit easy removal of the spike using a wrench or other rotary spike removal method. The threads are generally parallel, helical threads extending from the stand-off in the direction of the tip. The threads are adapted to cause rotation of the spike into the tie during installation using automated or manual impact spike-driving methods. In other words, the helical threads are preferably adapted to screw the spike threads into the wooden tie when a force is applied to the hemispherical head 13 of the spike in a direction generally towards the spike tip.

In another variation of this embodiment, the spike head is adapted for use with impact spike-driving methods. The hemispherical head 13 of the spike is preferably hemispherical or dome shaped and is adapted to for use with manual or automated impact spike-driving methods. Preferably, the hemispherical head 13 is adapted to deform slightly under impact driving, thereby preventing damage to the tool grip.

The present disclosure also provides a method of using an improved railroad spike to secure a metal rail and a metal tie plate to a wooden tie. The improved spike is described in the preceding detailed description of the present disclosure and in FIGS. 1-3D. The improved method comprises the step of driving the improved spike into the tie to secure the rail and the tie plate to the tie. The tie plate is adapted to engage the rail at the rail flange. The tie plate preferably comprises a metal boss or elastic fastener (e.g., an e-clip) that engages the rail flange when the improved spike of the present disclosure is driven into the tie, thereby securing the tie plate and the rail to the tie.

The improved spike of the present disclosure is preferably driven into the tie until the spike flange engages with the tie plate and the threads and barbs of the spike engage the wood of the tie. In the usual case, a hole or cavity (e.g., a pilot hole) is bored into the wooden tie before the spike tip is inserted into the tie plate cavity and the spike is driven into the hole or cavity of the tie. Preferably, the hole or cavity bored in the wooden tie has a diameter smaller than the diameter of the shank of the improved spike.

In some embodiments, a driving device is used to drive the spike into the tie, thereby securing the metal rail to the wooden tie. Generally, the driving device may be either an impact driver, such as a hammer, sledge, or maul; or a rotary driver, such as an open-end wrench, box end wrench, socket wrench, or socket driver. Preferably, an automated impact spike-driving method is employed.

Other embodiments of the present disclosure are within the scope of the following claims.

What is claimed is:

1. A rail anchoring spike for fastening metal tie plates to ties, comprising:

(a) a conical swell adapted to engage with a hole in a metal tie plate during fastening of said metal tie plate to a tie, said conical swell having a first end with a smaller diameter toward a pointed end of said spike and a second end with a larger diameter toward a head of said spike, said smaller diameter being slightly larger than a diameter of a body of said spike, wherein an angle formed by said conical swell relative to a center line passing through a center of said body of said spike matches an angle of said hole in said metal tie plate relative to a center of said hole;

(b) a flange on said head, said flange for engaging with a spike remover for future removal of said spike;

(c) a stand-off extending axially from said first end of said conical swell toward said pointed end of said spike, said stand-off positioned adjacent said first end of said conical swell;

(d) a threaded shank extending axially from said stand-off to form a tapered tip, said shank being adapted to engage said tie; and (e) a spacer extending axially from said flange, said spacer positioned adjacent said second end of said conical swell.

2. The rail anchoring spike of claim 1, said shank comprising:

(a) a plurality of helical, generally parallel threads extending over a threaded portion of said shank and running from said stand-off to said tapered tip, said stand-off having a length adapted to ensure that said threads are fully engaged in said tie when said spike is used to fasten metal to said tie, said threads for engaging said tie at a depth in said tie to ensure engagement with dense material of said tie; and (b) a plurality of barbs positioned in a lower half of said threaded portion, each of said barbs positioned between a pair of threads and configured to minimize damage to fibers of said tie during installation of said spike as fibers of said tie relax behind and engage with a barbed end of said barb to prevent movement of said spike over time despite deterioration of said tie, each of said barbs positioned along said threaded portion such that said barbs contact a lower portion of said tie when said spike is installed in a rail assembly.

3. The rail anchoring spike of claim 2, further comprising:

(a) a starting point oriented away from said flange and originating in a valley between said pair of threads;

(b) a pointed barb on said barbed end; and (c) a barb body extending from said starting point to said barbed end, said barb body growing in height and width relative to said valley, and said barb end forming a substantially flat surface oriented generally perpendicular to an axis of said pointed barb and to ridges formed by said pair of threads.

4. A rail anchoring assembly, comprising:

(a) a metal tie plate adapted for fastening a rail to a tie using three or more spikes driven through corresponding conical holes in said metal tie plate and into said tie, each conical hole having an angle matching an angle of corresponding conical swells of said three or more spikes, and each conical hole having upper and lower diameters smaller than or equal to corresponding upper and lower diameters of each of said three or more spikes; and (b) three or more spikes, each spike of said three or more spikes comprising:

(i) a conical swell adapted to engage with a hole in said metal tie plate during fastening of said metal tie plate to said tie, said conical swell having a first end with a smaller diameter toward a pointed end of said spike and a second end with a larger diameter toward a head of said spike, said smaller diameter being slightly larger than a diameter of a body of said spike, wherein an angle formed by said conical swell relative to a center line passing through a center of said body of said spike matches an angle of said hole in said metal tie plate relative to a center of said hole;

(ii) a flange on said head, said flange for engaging with a spike remover for future removal of said spike;

(iii) a stand-off extending axially from said first end of said conical swell toward said pointed end of said spike, said stand-off positioned adjacent said first end of said conical swell;

(iv) a threaded shank extending axially from said stand-off to form a tapered tip, said shank being adapted to engage said tie; and (v) a spacer extending axially from said flange, said spacer positioned adjacent said second end of said conical swell.

5. The rail anchoring assembly of claim 4, said shank comprising:

(a) a plurality of helical, generally parallel threads extending over a threaded portion of said shank and running from said stand-off to said tapered tip, said stand-off having a length adapted to ensure that said threads are fully engaged in said tie when a spike is used to fasten metal to said tie, said threads for engaging said tie at a depth in said tie to ensure engagement with dense material of said tie; and (b) a plurality of barbs positioned in a lower half of said threaded portion, each of said barbs positioned between a pair of threads and configured to minimize damage to fibers of said tie during installation of said spike as fibers of said tie relax behind and engage with a barbed end of said barb to prevent movement of said spike over time despite deterioration of said tie, each of said barbs positioned along said threaded portion such that said barbs contact a lower portion of said tie when said spike is installed in a rail assembly.

6. The rail anchoring assembly of claim 5, each spike of said three or more spikes further comprising:

(a) a starting point oriented away from said flange and originating in a valley between said pair of threads;

(b) a pointed barb on said barbed end; and (c) a barb body extending from said starting point to said barbed end, said barb body growing in height and width relative to said valley, and said barb end forming a substantially flat surface oriented generally perpendicular to an axis of said pointed barb and to ridges formed by said pair of threads.

7. The rail anchoring spike of claim 1, wherein said larger diameter of said second end of said conical swell is larger than a diameter of said spacer.

8. The rail anchoring spike of claim 1, wherein said spacer is positioned between an end of said flange and said second end of said conical swell.

9. The rail anchoring spike of claim 1, wherein said smaller diameter of said first end of said conical swell is larger than a diameter of said standoff.

* * * * *